US005813201A

United States Patent [19]

Hsi-Chang

[11] Patent Number: 5,813,201

[45] Date of Patent: Sep. 29, 1998

[54] EQUESTRIAN BIT

[75] Inventor: Chang Hsi-Chang, Taichung, Taiwan

[73] Assignee: Eastwest International Enterprises, Taichung, Taiwan

[21] Appl. No.: 843,391

[22] Filed: Apr. 15, 1997

[30] Foreign Application Priority Data

| | | | |
|---|---|---|---|
| Jul. 5, 1996 | [CN] | China | 96 2 16764.9 |
| Jul. 5, 1996 | [CN] | China | 96 3 07256.0 |
| Aug. 13, 1996 | [CN] | China | 96 3 07088.6 |
| Aug. 14, 1996 | [CN] | China | 96 3 18141.6 |
| Aug. 14, 1996 | [CN] | China | 96 3 18345.1 |
| Aug. 14, 1996 | [CN] | China | 96 3 18346.X |

[51] Int. Cl.[6] ..... B68B 1/06

[52] U.S. Cl. ..... 54/7

[58] Field of Search ..... 54/7, 8, 9

[56] References Cited

U.S. PATENT DOCUMENTS

| | | | |
|---|---|---|---|
| 326,648 | 9/1885 | Heinze | 54/8 |
| 390,567 | 10/1888 | Cahoone | 54/8 |
| 3,623,294 | 11/1971 | Stone et al. | 54/8 |
| 4,965,987 | 10/1990 | Bork | 54/7 |

*Primary Examiner*—Robert P. Swiatek
*Attorney, Agent, or Firm*—Antonio R. Durando

[57] ABSTRACT

An equestrian bit consists of a steel core which is at least partly encased in plastic. The core is made up of two holding members for the rings attached to the reins of a horse, and an elongated bendable member which connects the holding members to one another. Each of the holding members includes a tubular portion which is provided with a shoulder at either end. When the core is coated with plastic by injection molding, the shoulders enhance the flow of plastic around the tubular portions. Each of the holding members further includes a protrusion which projects outward from the peripheral surface of the respective tubular portion. The protrusions are formed with channels which receive the ends of the connecting member, and such ends are soldered, brazed or welded to the protrusions. Insertion of the ends of the connecting member in the channels allows a strong bond to be achieved between the connecting member and the holding members.

21 Claims, 4 Drawing Sheets

EQUESTRIAN BIT

BACKGROUND OF THE INVENTION

1. Field of the Invention

The invention relates to an equestrian bit.

2. Description of the Prior Art

One conventional type of equestrian bit includes a core which is encased in plastic. The core is made up of two tubular members coupled to the reins, and an elongated bendable member which extends between and is connected to the tubular members.

To manufacture a bit of this kind, the ends of the bendable member are butted against and then welded to the curved outer peripheral surfaces of the tubular members. The resulting joints are relatively weak because the ends of the bendable member do not properly conform to the curvatures of the peripheral surfaces.

After the bendable member has been welded to the tubular members, the resulting core is encased in plastic by injection molding. It is difficult to coat the end portions of the tubular members and high molding pressures must be employed to insure that the end portions are properly encased. However, this can cause the bendable member of the core to change position.

SUMMARY OF THE INVENTION

It is an object of the invention to provide a structure which enables the core of a bit to have increased strength.

Another object of the invention is to provide a structure which allows the core of a bit to be properly coated at reduced molding pressures.

An additional object of the invention is to provide a method which makes it possible to increase the strength of the core of a bit.

A further object of the invention is to provide a method which permits lower molding pressures to be used in coating the core of a bit.

The preceding objects, as well as others which will become apparent as the description proceeds, are achieved by the invention.

One aspect of the invention resides in a bit. The bit comprises a first member including a first tubular portion for cooperating with a rein, a second member including a second tubular portion for cooperating with a rein, and a connecting member for connecting the first member and the second member to one another.

In accordance with one embodiment of the bit, at least one of the first and second members includes a protrusion for attachment to the connecting member.

The protrusion forms a holding or anchoring element which can be adapted to the connecting member. By adapting the protrusion to the connecting member, the area of the joint between the connecting member and the respective tubular portion can be increased thereby resulting in greater strength.

According to another embodiment of the bit, at least one end of a tubular portion is provided with a shoulder.

When the tubular portion is coated, the shoulder allows material to flow around the respective end more easily. Hence, less pressure is required to encase such end.

Additional features and advantages of the invention will be forthcoming from the following detailed description of preferred embodiments when read in conjunction with the accompanying drawings.

DESCRIPTION OF THE PREFERRED EMBODIMENTS

Figure 1:
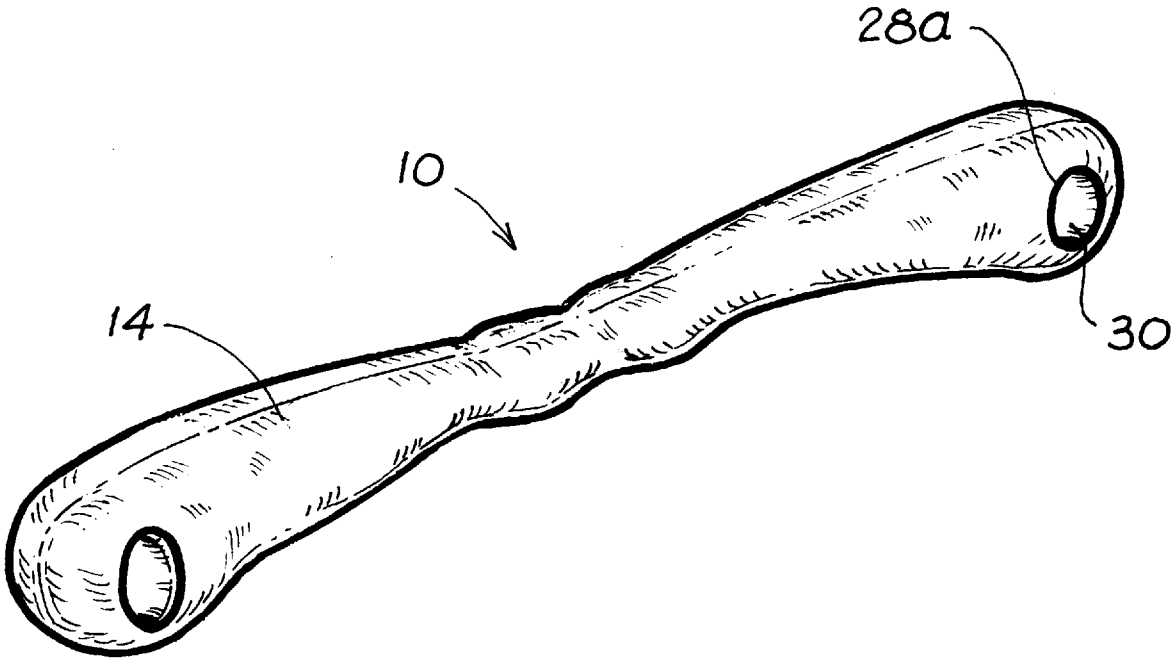
FIG. 1 is a perspective view of one embodiment of an equestrian bit in accordance with the invention.
Figure 2:
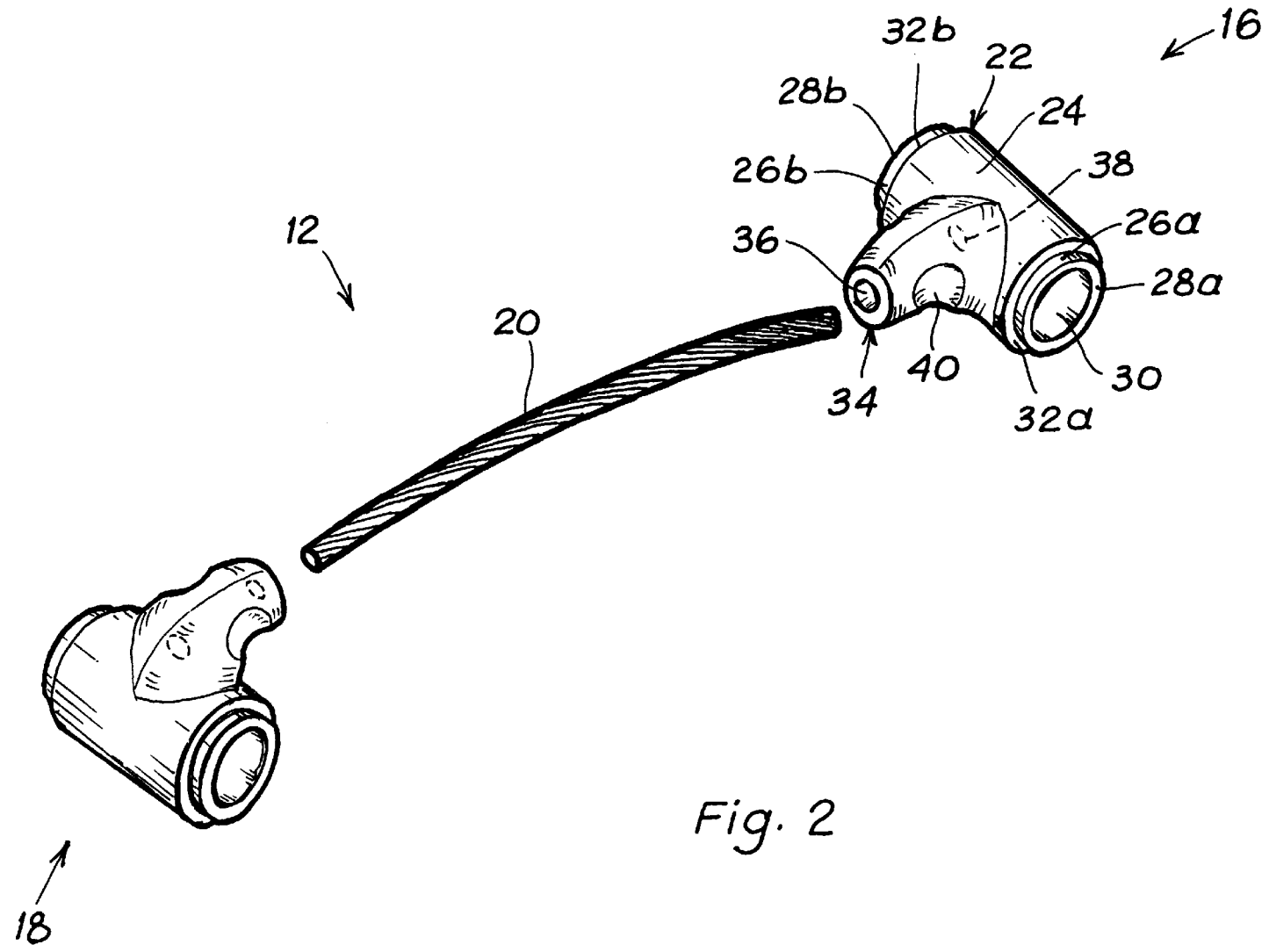
FIG. 2 is an exploded view of a core for the bit of FIG. 1.

Referring to FIG. 1, the numeral 10 identifies an equestrian bit in accordance with the invention. The bit 10 includes a metallic core 12 which is shown in FIG. 2 and is encased in a plastic sheath or coating 14.

The core 12 comprises two metallic holding or anchoring members 16 and 18 which are designed to be fastened to, and to cooperate with, the rings connected to the reins of a horse. The core 12 further comprises an elongated flexible or bendable member 20 which serves to connect the holding members 16,18 to one another. Each end of the connecting member 20 is joined to one of the holding members 16,18 by a bonding material. The connecting member 20 is in the form of a stranded cable having a circular cross section and can, for example, be made of stainless steel.

The holding members 16,18 are identical, and the structure of the holding members 16,18 will be described with reference to the holding member 16.

The holding member 16 includes an elongated tubular portion 22 having a cylindrical center section 24 and opposite cylindrical end sections 26*a* and 26*b*. The end sections 26*a*,26*b* have respective end faces 28*a* and 28*b*, and the tubular portion 22 defines a passage 30 which extends longitudinally of the tubular portion 22 between the end faces 28*a*,28*b*.

The center section 24 and end sections 26*a*,26*b* all have the same inner diameter. On the other hand, the outer diameter of the center section 24 exceeds the outer diameters of the end sections 26*a*,26*b*. Accordingly, the center section 24 defines a shoulder or step 32*a* with the end section 26*a* and a shoulder or step 32*b* with the end section 26*b*.

The outer diameters of the end sections 26*a*,26*b* are preferably equal. Likewise, it is preferred for the end sections 26*a*,26*b* to have the same length.

A protrusion 34 is mounted on the center section 24 of the tubular portion 22 midway between the end sections 26*a*, 26*b* and projects outwardly from the external peripheral surface of the center section 24. The protrusion 34 is provided with a channel 36 which extends transverse to the passage 30 of the tubular portion 22, and the channel 36 is in the form of a blind bore terminating at an interior wall 38 of the protrusion 34. The channel 36 has a diameter somewhat larger than that of the connecting member 20, and the ends of the connecting member 20 are received in the channel 36.

The protrusion 34 is further provided with one or more recesses 40 through which the connecting member 20 is bonded to the protrusion 34. The recess or recesses 40 accommodate a bonding material which joins the connecting member 20 to the protrusion 34.

The protrusion 34 and the channel 36 are here curved. This allows the connecting member 20 to have a curvature as illustrated.

The length of the tubular portion 22, as well as the inner and outer diameters of the center section 24 and end sections 26*a*,26*b*, can be selected in dependence upon the size of a horse's mouth and upon the type of bit desired. The same holds true for the length and diameter of the connecting member 20 and for the length and curvature of the protrusion 34.

To make the bit 10, the ends of the connecting member 20 are inserted in the protrusions 34 of the holding members 16,18. The connecting member 20 is then soldered, brazed or welded to the protrusions 34 by way of the recess or recesses 40 to form the core 12. The connecting member 20 of the core 12 is secured to the protrusions 34 via fused bonding material confined in the recess or recesses 40.

The core 12 is placed in a mold and plastic is injected around the core 12 to form the sheath 14 and complete the bit 10.

The bit 10 is elongated as seen in FIG. 1. The holding members 16,18 are located at the respective ends, and the connecting member 20 extends in longitudinal direction, of the bit 10. Due to the curvatures of the protrusions 34 and the connecting member 20, the bit 10 is curved longitudinally thereof. The holding members 16,18 are disposed transversely, and the end faces 28*a*,28*b* of the holding members 16,18 are visible at opposite sides, of the bit 10. The passages 30 of the holding members 16,18 open to such sides of the bit 10 and normally receive metal rings attached to the reins of a horse.

The protrusions 34 provide a firm anchor for the connecting member 20. By forming the protrusions 34 with channels 36 and inserting the connecting member 20 therein, a joint of relatively large area may be established between the connecting member 20 and the protrusions 34. Hence, the core 12 can have high strength. Insertion of the connecting member 20 in the protrusions 34 also prevents the connecting member 20 from snapping off. Moreover, since the protrusions 34 can be curved, it is possible to impart a desired curvature to the connecting member 20.

The shoulders 32*a*,32*b* at the ends of the holding members 16,18 allow the outer peripheral surfaces of the tubular portions 22 to be completely covered with plastic at moderate, rather than very high, injection pressures. This is of advantage because very high injection pressures can cause the connecting member 20 to change its position. Should the position of the connecting member 20 change, the bit 10 can undergo breakage or deformation. It may then be necessary to discard the bit 10 thereby leading to production losses. Furthermore, very high injection pressures can lead to undesirable burrs at the ends of the holding members 16,18 upon removal of the bit 10 from the mold. The extra space created by the reduction in diameter at the shoulders 32*a*,32*b* also has the desirable effect that the end faces 28*a*,28*b* of the holding members 16,18 are exposed, or are covered by an easily removable plastic residue, when the bit 10 is discharged from the mold. Thus, the metal rings attached to the reins of a horse and inserted in the passages 30 of the bit 10 can move more easily and smoothly over the metallic end faces 28*a*,28*b* than over a plastic coating.

Figure 3:
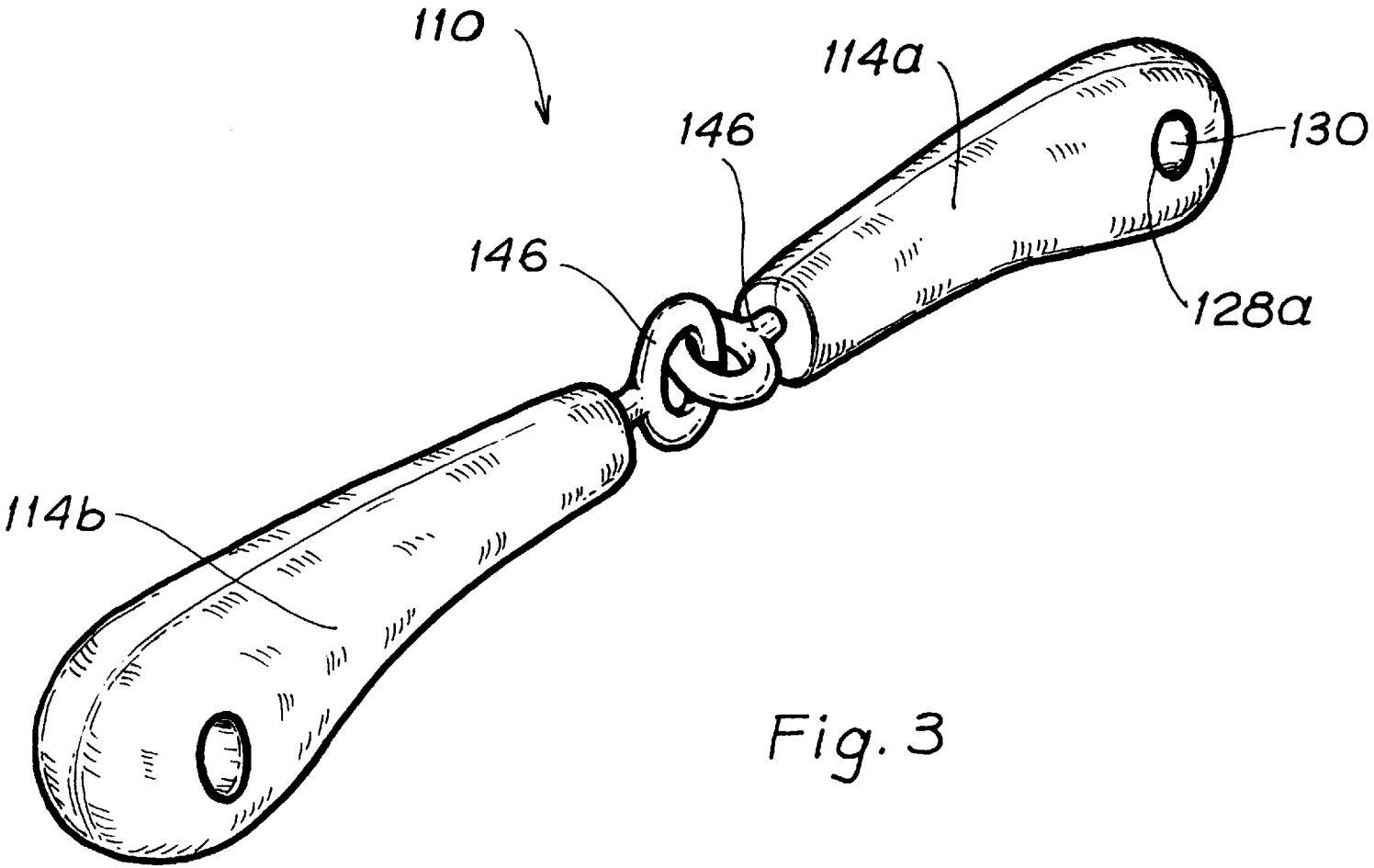
FIG. 3 is a perspective view of another embodiment of an equestrian bit according to the invention.
Figure 4:
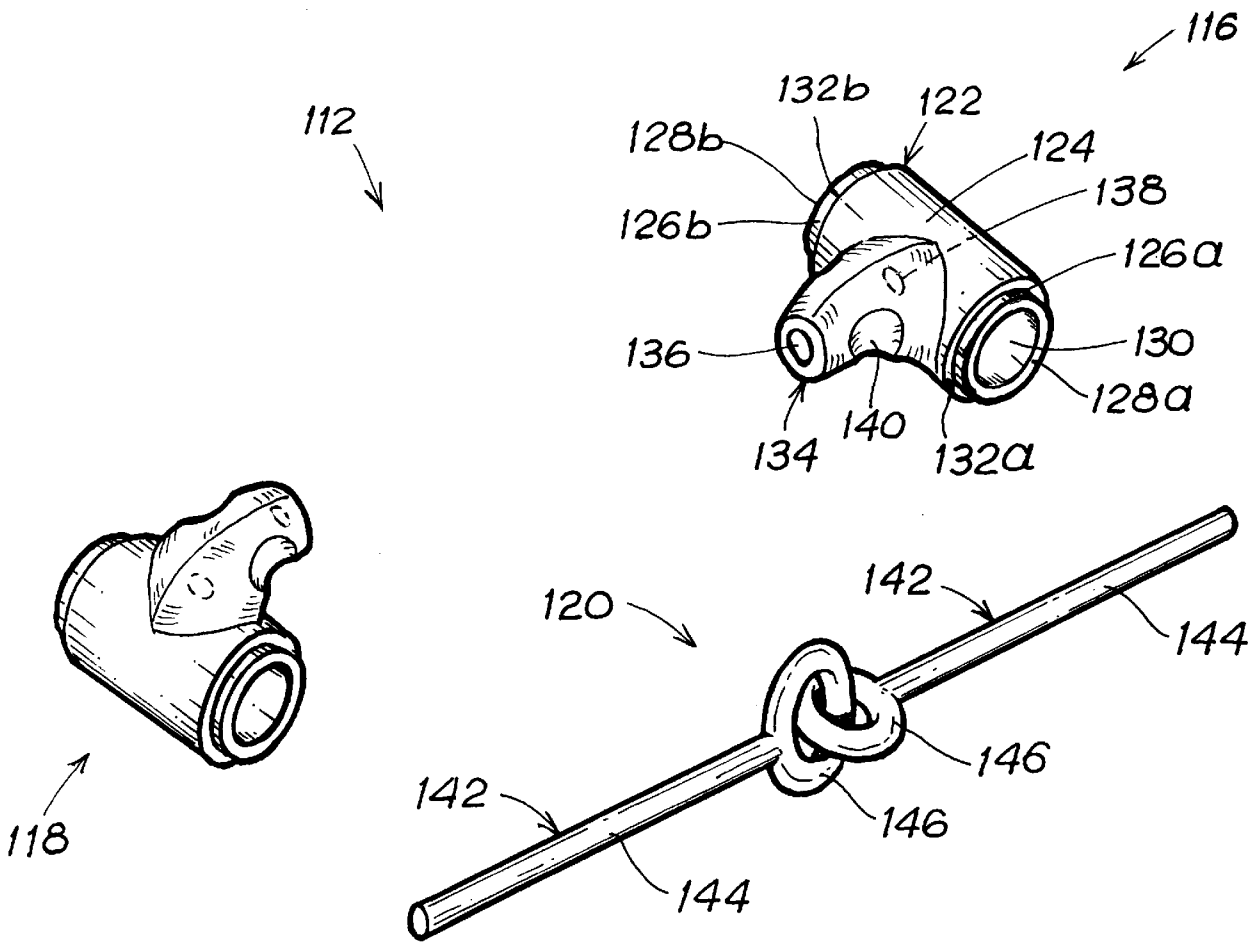
FIG. 4 is an exploded view of a core for the bit of FIG. 3.

Turning to FIGS. 3 and 4, the same reference numerals as in FIGS. 1 and 2 plus one-hundred are used to identify corresponding elements. FIG. 3 illustrates a bit 110 according to the invention while FIG. 4 shows a core 112 of the bit 110.

The bits 10 and 110 differ in the structures of the connecting members 20 and 120. Thus, instead of a stranded cable, the connecting member 120 is made up of two connecting elements 142 consisting of solid steel rod. Each of the connecting elements 142 includes a straight rod section 144 and an eye 146 at one end of the respective straight rod section 144. The eyes 146 are linked so as to be freely movable with respect to one another thereby enabling the connecting member 120 to bend by relative rotation of the connecting elements 142. The ends of the connecting elements 142 remote from the eyes 146 are inserted in the channels 136 of the protrusions 134.

Unlike the bit 10 which has a single sheath 14 extending over its length, the bit 110 includes two discrete sheaths 114*a* and 114*b* which are separated by a gap. The eyes 146 of the connecting member 120 are located in the gap, and the eyes 146 are exposed thereby permitting the bit 110 to bend. The sheath 114*a* encases the holding member 116 and the straight rod section 144 bonded to the same while the sheath 114*b* encases the holding member 118 and the straight rod section 144 bonded thereto. The eyes 146 are situated about midway along the length of the bit 110 which is a position corresponding approximately to the middle of a horse's mouth.

Various modifications can be made within the meaning and range of equivalence of the appended claims. For example, the protrusions 34,134 can be straight rather than curved and, under appropriate circumstances, the channels 36,136 of the protrusions 34,134 may be eliminated. Furthermore, the cores 12,112 may be made of materials other than steel and could be connected to the holding members 16,18,116,118 by attachment means other than solders, brazes and welds.

I claim:

1. A bit comprising:

a first member including a first tubular portion for cooperating with a rein, said first tubular portion having a first external peripheral surface;

a second member including a second tubular portion for cooperating with a rein, said second tubular portion having a second external peripheral surface; and a connecting member for connecting said first member and said second member to one another, at least one of said first and second members including a protrusion for attachment to said connecting member, and said protrusion projecting outward from the respective external peripheral surface;

wherein said protrusion is provided with a recess for bonding material between said protrusion and said connecting member.

2. The bit of claim 1, wherein each of said first and second members includes a protrusion for attachment to said connecting member, each of the protrusions projecting outward from the respective external peripheral surface.

3. The bit of claim 1, wherein said protrusion is provided with a channel for receiving said connecting member.

4. The bit of claim 3, wherein said channel is curved.

5. The bit of claim 4, wherein said protrusion and said connecting member are curved.

6. The bit of claim 1, wherein said connecting member is attached to said protrusion by fused material.

7. The bit of claim 1, wherein said connecting member is bendable.

8. The bit of claim 1, further comprising a coating on said tubular portions and said connecting member.

9. The bit of claim 8, wherein said coating comprises plastic.

10. A bit comprising:

a first member including a first tubular portion for cooperating with a rein, said first tubular portion having opposed first ends;

a second member including a second tubular portion for cooperating with a rein, said second tubular portion having opposed second ends; and a connecting member for connecting said first member and said second member to one another, each of said ends being provided with a shoulder consisting of a step in the tubular portion corresponding thereto.

11. The bit of claim 10, wherein said first tubular portion has a first external peripheral surface and said second tubular portion has a second external peripheral surface, at least one of said first and second members including a protrusion for attachment to said connecting member, and said protrusion projecting outward from the respective external peripheral surface.

12. A bit comprising:

a first member including a first tubular portion for cooperating with a rein, said first tubular portion having opposed first ends;

a second member including a second tubular portion for cooperating with a rein, said second tubular portion having opposed second ends; and a connecting member for connecting said first member and said second member to one another, at least one of said ends being provided with a shoulder;

wherein said first tubular portion has a first external peripheral surface and said second tubular portion has a second external peripheral surface, at least one of said first and second members including a protrusion for attachment to said connecting member, and said protrusion projecting outward from the respective external peripheral surface; and wherein said protrusion is provided with a recess for bonding material between said protrusion and said connecting member.

13. The bit of claim 12, wherein each of said ends is provided with a shoulder.

14. The bit of claim 12, wherein each of said first and second members includes a protrusion for attachment to said connecting member, each of the protrusions projecting outward from the respective external peripheral surface.

15. The bit of claim 12, wherein said protrusion is provided with a channel for receiving said connecting member.

16. The bit of claim 15, wherein said channel is curved.

17. The bit of claim 16, wherein said protrusion and said connecting member are curved.

18. The bit of claim 12, wherein said connecting member is attached to said protrusion by fused material.

19. The bit of claim 12, wherein said connecting member is bendable.

20. The bit of claim 12, further comprising a coating on said tubular portions and said connecting member.

21. The bit of claim 20, wherein said coating comprises plastic.

* * * * *

UNITED STATES PATENT AND TRADEMARK OFFICE

CERTIFICATE OF CORRECTION

PATENT NO : 5,813,201

DATED : September 29, 1998

INVENTOR(S) : Chang Hsi-Chang

It is certified that error appears in the above-identified patent and that said Letters Patent is hereby corrected as shown below:

On the top page, item [73] Assignee, add --(Taiwan)-- after International

Signed and Sealed this

Twenty-third Day of February, 1999

*Attest:*

Q. TODD DICKINSON

*Attesting Officer*

*Acting Commissioner of Patents and Trademarks*